US010941585B2

(12) United States Patent
Sun et al.

(10) Patent No.: US 10,941,585 B2
(45) Date of Patent: Mar. 9, 2021

(54) CENTRAL LOCK FOR FOLDING TENT

(71) Applicant: ZHEJIANG JIANSHENG LEISURE PRODUCTS CO., LTD, Zhejiang (CN)

(72) Inventors: Yuanru Sun, Zhejiang (CN); Chao Zeng, Zhejiang (CN); Qiwang Ying, Zhejiang (CN); Jian He, Zhejiang (CN)

(73) Assignee: ZHEJIANG JIANSHENG LEISURE PRODUCTS CO., LTD, Zhejiang (CN)

( * ) Notice: Subject to any disclaimer, the term of this patent is extended or adjusted under 35 U.S.C. 154(b) by 0 days.

(21) Appl. No.: 16/642,013

(22) PCT Filed: Aug. 15, 2019

(86) PCT No.: PCT/CN2019/100687

§ 371 (c)(1),
(2) Date: Feb. 25, 2020

(65) Prior Publication Data

US 2020/0240167 A1 Jul. 30, 2020

(30) Foreign Application Priority Data

Aug. 6, 2019 (CN) ..... 201921262392.3

(51) Int. Cl.
*E04H 15/50* (2006.01)
*E04H 15/48* (2006.01)
(Continued)

(52) U.S. Cl.
CPC ..... *E04H 15/50* (2013.01); *E04H 15/48* (2013.01); *E04H 15/52* (2013.01); *A45B 25/08* (2013.01)

(58) Field of Classification Search
CPC ..... E04H 15/32; E04H 15/48; E04H 15/50; E04H 15/52; A45B 25/08
(Continued)

(56) References Cited

U.S. PATENT DOCUMENTS 4,627,210 A * 12/1986 Beaulieu ..... A45B 25/10 52/646
10,273,711 B2 * 4/2019 Song ..... E04H 15/48
(Continued)

FOREIGN PATENT DOCUMENTS

DE 202019102725 U1 * 7/2019 ..... E05B 65/00
DE 202019106527 U1 * 12/2019 ..... E04H 15/26
(Continued)

OTHER PUBLICATIONS

"Written Opinion of the International Searching Authority (Form PCT/ISA/237) of PCT/CN2019/100687," dated May 7, 2020, with English translation thereof, pp. 1-13.

*Primary Examiner* — Robert Canfield
(74) *Attorney, Agent, or Firm* — JCIPRNET

(57) ABSTRACT

A central lock for a folding tent includes a central lock rod, an upper lock plate fixedly disposed at one end of the central lock rod, and a lower lock plate assembly detachably connected to the other end of the central lock rod. An elastic locking member and an unlocking mechanism used to control the elastic locking member to be locked are disposed in the lower lock plate assembly. The elastic locking member includes an arc-shaped portion provided integrally and two horizontal locking rods extending inwards from a gap of the arc-shaped portion. A lower end portion of the central lock rod is provided with a locking groove used in cooperation with the locking rod and a clamping and locking portion located at a lower end of the locking groove.

9 Claims, 16 Drawing Sheets

(51) Int. Cl.
*E04H 15/32* (2006.01)
*E04H 15/52* (2006.01)
*A45B 25/08* (2006.01)

(58) Field of Classification Search
USPC ..... 135/131, 135, 143, 145, 147, 159, 28, 135/38–40
See application file for complete search history.

(56) References Cited

U.S. PATENT DOCUMENTS

| | | | | |
|---|---|---|---|---|
| 2018/0103734 | A1* | 4/2018 | Song | E04H 15/34 |
| 2018/0125184 | A1* | 5/2018 | Song | E04H 15/50 |
| 2019/0234102 | A1* | 8/2019 | Lu | E04H 15/46 |
| 2019/0368220 | A1* | 12/2019 | Sun | E04H 15/18 |
| 2019/0368232 | A1* | 12/2019 | Sun | E05B 65/00 |
| 2020/0240168 | A1* | 7/2020 | Sun | E04H 15/50 |

FOREIGN PATENT DOCUMENTS

| | | | | |
|---|---|---|---|---|
| DE | 202020100308 | U1 * | 2/2020 | E04H 15/50 |
| DE | 202020100324 | U1 * | 2/2020 | E04H 15/32 |
| WO | 2017028659 | | 2/2017 | |

* cited by examiner

CENTRAL LOCK FOR FOLDING TENT

CROSS-REFERENCE TO RELATED APPLICATION

This application is a 371 of international application of PCT application serial no. PCT/CN2019/100687, filed on Aug. 15, 2019, which claims the priority benefit of China application no. 201921262392.3, filed on Aug. 6, 2019. The entirety of each of the above mentioned patent applications is hereby incorporated by reference herein and made a part of this specification.

BACKGROUND

Technical Field

The present invention belongs to the field of technologies of components of folding tents, and specifically, to a central lock for a folding tent.

Description of Related Art

With the development of the tent industry, folding tents are widely used, and a central lock is a key component to unfold, fold, and store a tent. A traditional central lock has a complicated structure, unfolding, folding, and storage procedures are relatively tedious, and operations are cumbersome. This brings inconvenience to users. Consequently, rapid development of the tent industry is restricted.

SUMMARY

In view of the problems existing in the prior art, an objective of a design of the present invention is to provide a central lock for a folding tent.

The present invention is implemented based on the following technical solutions.

A central lock for a folding tent includes a central lock rod, an upper lock plate fixedly disposed at one end of the central lock rod, and a lower lock plate assembly detachably connected to the other end of the central lock rod. An elastic locking member and an unlocking mechanism used to control the elastic locking member to be locked are disposed in the lower lock plate assembly, the elastic locking member includes an arc-shaped portion provided integrally and two horizontal locking rods extending inwards from a gap of the arc-shaped portion, a lower end portion of the central lock rod is provided with a locking groove used in cooperation with the locking rods and a clamping and locking portion located at a lower end of the locking groove, and specifically, the locking rods are clamped in the locking groove to implement locking.

The lower lock plate assembly includes an upper plate, an intermediate plate, and a lower plate. The upper plate is hingedly connected to a short tent bone, and the upper plate is fixedly connected to the intermediate plate by a screw. A space used to place the elastic locking member is disposed between the intermediate plate and the upper plate, the lower plate is sleeved on a lower end of the intermediate plate, guiding columns are symmetrically disposed on an outer wall of the lower end of the intermediate plate, and a guiding trough is provided at locations, corresponding to the guiding columns, of an inner wall of the lower plate. The unlocking mechanism includes an unlocking block and an unlocking column fixedly disposed at a lower end of the unlocking block, the unlocking column extends through the intermediate plate to the lower plate and is then fixed by a screw, the unlocking block is in a trapezoid shape, an upper end of the unlocking block has a width larger than that of the lower end of the unlocking block. In a locked state, a narrow portion of the lower end of the unlocking block is clamped at the gap of the elastic locking member.

The lower lock plate assembly includes an upper plate and a central base, the upper plate and the central base are fixedly connected by a screw, a space used to place the elastic locking member is provided between the upper plate and an upper portion of the central base, and the unlocking mechanism extends through the central base to lock the elastic locking member.

The unlocking mechanism includes an unlocking block, an unlocking column fixedly disposed at a lower end of the unlocking block, a compression spring sleeved on the unlocking column, a button cover, and an inclined conical surface block, the bottom cover is clamped on a bottom portion of the central base, the unlocking column is fixed on the button cover after extending through the central base, a cross section of the unlocking block is a triangle and a surface of an end of the unlocking block is arc-shaped, an intermediate portion of the arc-shaped portion of the elastic locking member abuts on an upper end of an arc-shaped surface of the unlocking block, and the inclined conical surface block is correspondingly disposed at the gap of the elastic locking member.

The unlocking mechanism includes a columnar unlocking block, an unlocking column disposed at a lower portion of the columnar unlocking block, a compression spring, a pull ring, a pull ring fixing block, and an inclined conical surface block, the pull ring fixing block is fixedly disposed at a bottom portion of the central base, the compression spring is sleeved on the unlocking column, the pull ring is disposed at an end portion of the unlocking column after the unlocking column extends through the pull ring fixing block, a side surface of the columnar unlocking block is provided with an arc-shaped gap, an intermediate portion of the arc-shaped portion of the elastic locking member abuts on a lower end of the arc-shaped gap, and the inclined conical surface block is correspondingly disposed at the gap of the elastic locking member.

A width of an end, of the inclined conical surface block, close to the gap of the elastic locking member is smaller, and a width of an end far away from the gap of the locking member is larger.

The inclined conical surface block is disposed on a bottom surface of the upper plate or a surface of an upper end of the central base.

The lower lock plate assembly includes an upper plate and a rotary base, a central shaft of a hollow structure is disposed on a lower bottom surface of the upper plate, a center hole through which the central shaft extends is provided on the rotary base, two outer annular installation grooves that are spaced apart are formed on an outer wall of the rotary base, two inner annular installation grooves are formed at locations, corresponding to the two outer annular installation grooves, of an outer wall of the central shaft, outer limit blocks are disposed between the two outer annular installation grooves, inner limit blocks are disposed between the two inner annular installation grooves, and after the elastic locking member enters from the outer annular installation grooves, outer sides of the gap of the elastic locking member respectively abut on the two outer limit blocks, and the two locking rods respectively abut on the two inner limit blocks.

A width between the two locking rods is not less than a width between the inner limit blocks.

The present invention has a simple structure and is easy to implement. A production and installation process is convenient and fast, and has low costs. In addition, the structure of the central lock is simple to operate, and a folding operation can be implemented by only performing pulling down or screwing after pushing up in one step. Therefore, the central lock is very convenient to use and is easy to promote and apply.

DESCRIPTION OF THE EMBODIMENTS

The present invention is further described in detail below with reference to the accompanying drawings of the specification, and specific embodiments are provided.

Figure 1:
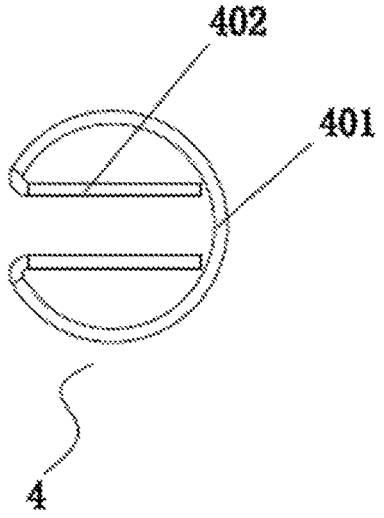
FIG. 1 is a schematic structural diagram of an elastic locking member according to the present invention.
Figure 2:
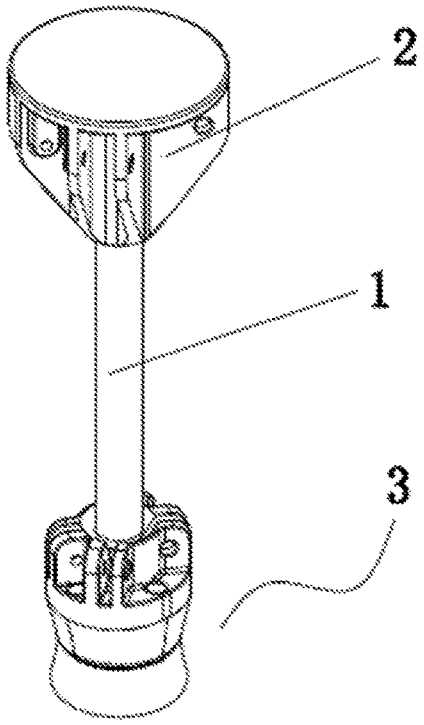
FIG. 2 is a schematic diagram of an entire structure of a central lock in an embodiment 1.
Figure 3:
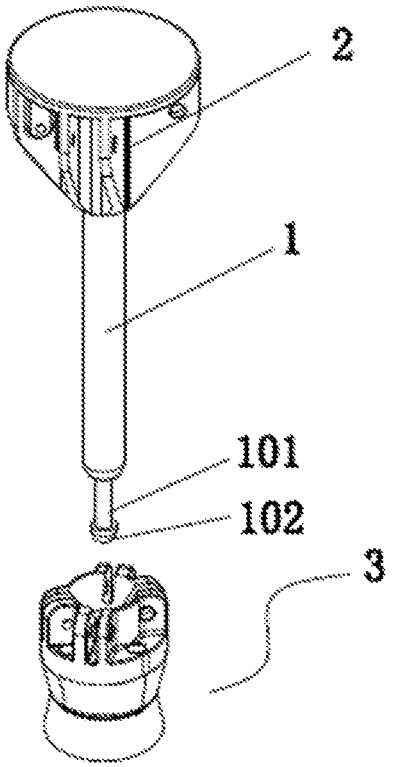
FIG. 3 is a schematic structural diagram when a lock plate in FIG. 2 is detached.
Figure 4:
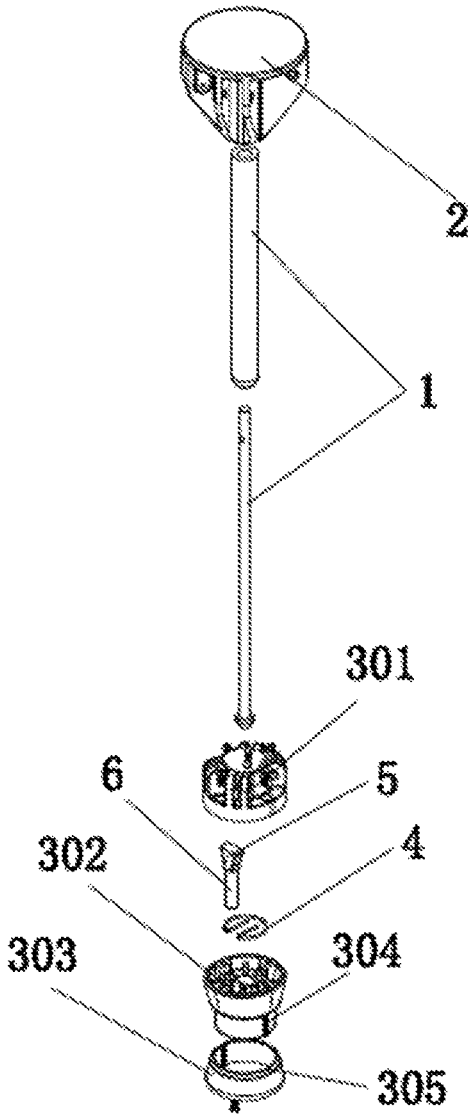
FIG. 4 is an expanded view of FIG. 2.
Figure 5:
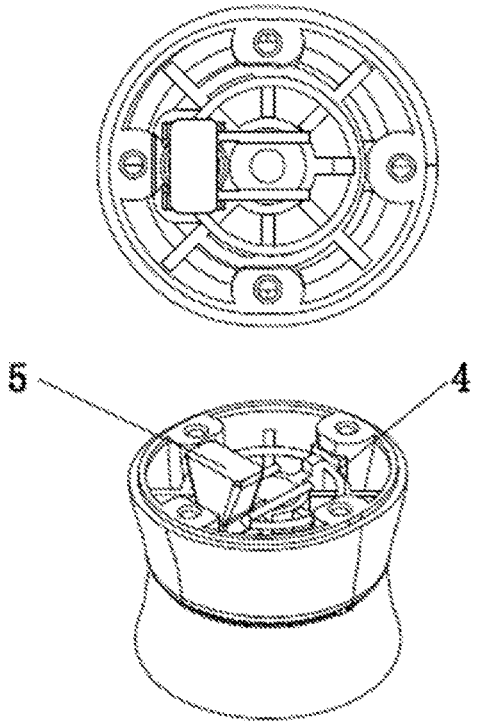
FIG. 5 is a schematic structural diagram of a lower lock plate assembly in the embodiment 1.
Figure 6:
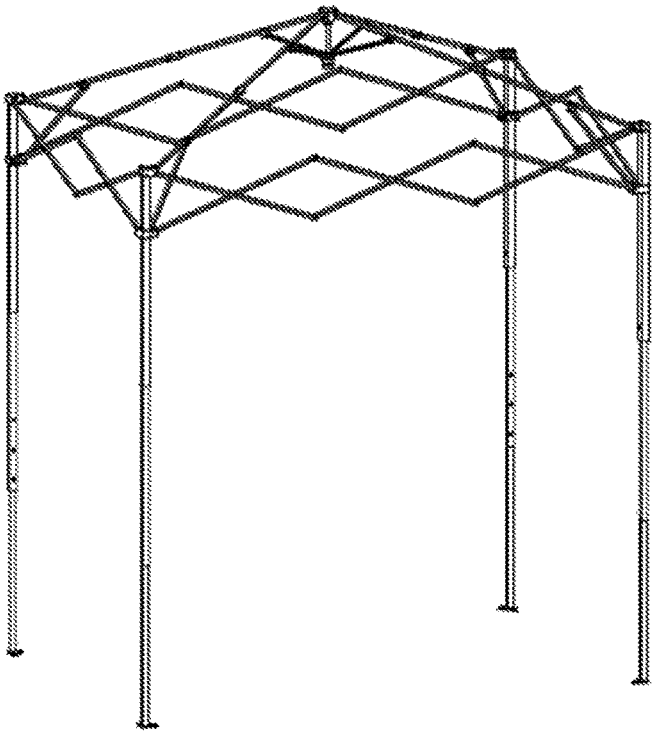
FIG. 6 is a schematic structural diagram when a central lock in the embodiment 1 is installed on a folding tent.
Figure 7:
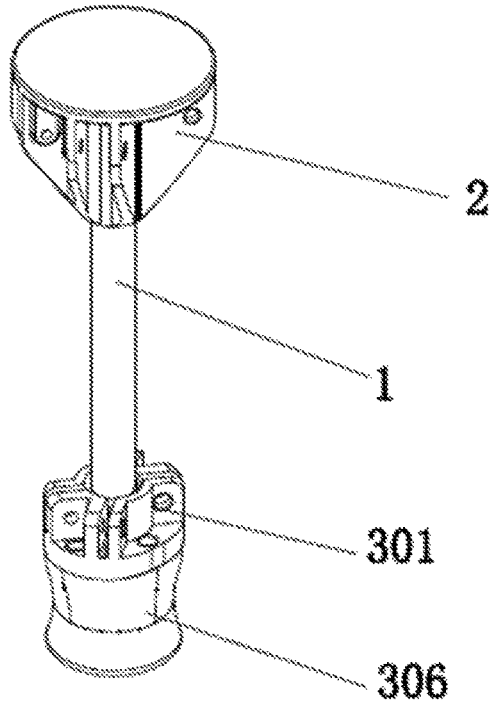
FIG. 7 is a schematic diagram of an entire structure of a central lock in an embodiment 2.
Figure 8:
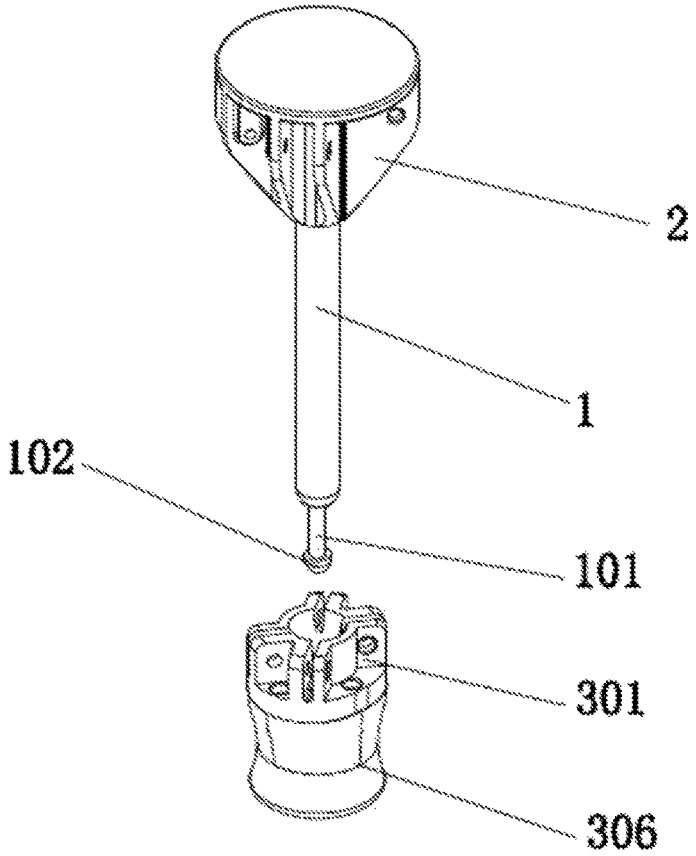
FIG. 8 is a schematic structural diagram when a lock plate in FIG. 7 is detached.
Figure 9:
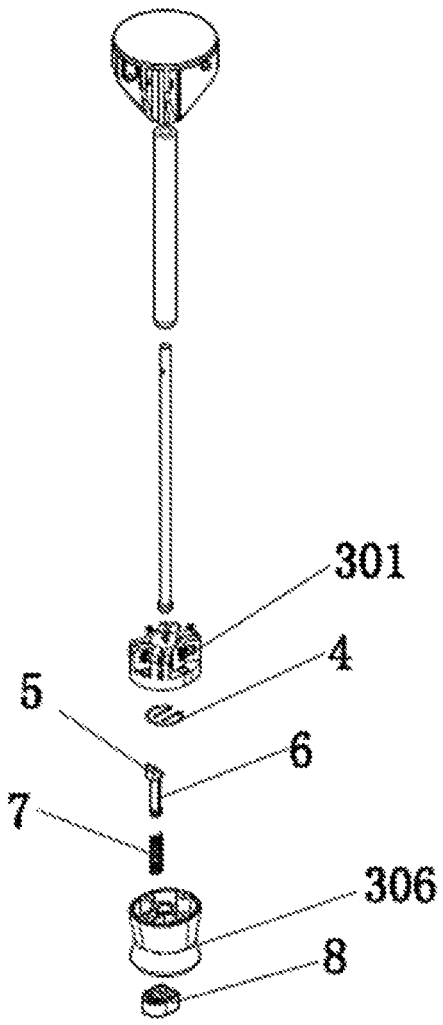
FIG. 9 is an expanded view of FIG. 7.
Figure 10:
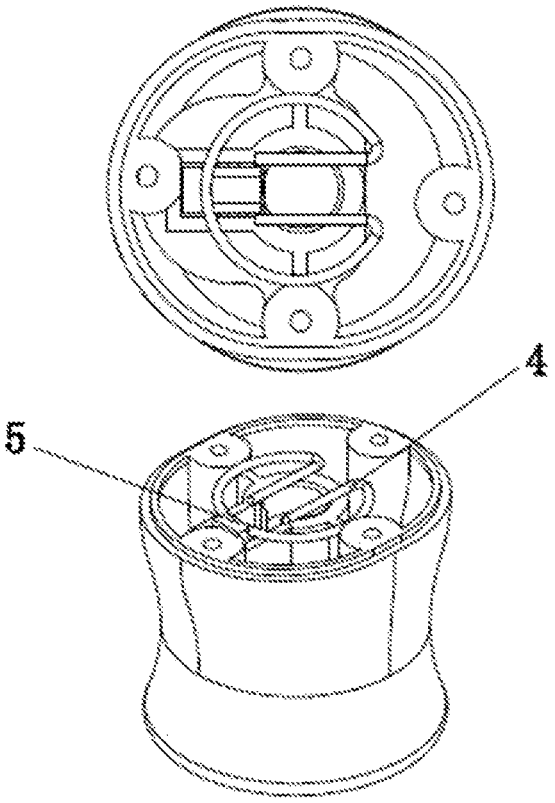
FIG. 10 is a schematic structural diagram of a lower lock plate assembly in the embodiment 2.
Figure 11:
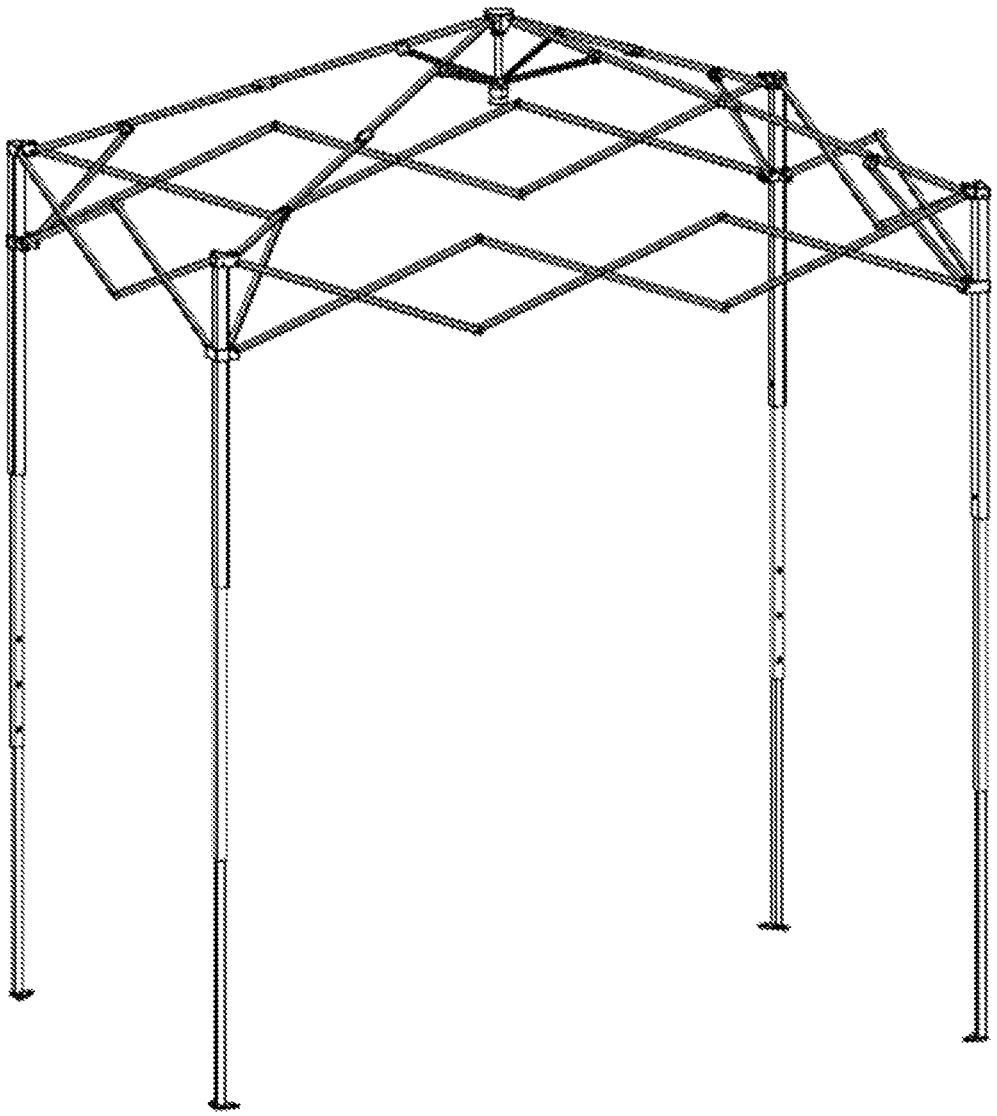
FIG. 11 is a schematic structural diagram when a central lock in the embodiment 2 is installed on a folding tent.
Figure 12:
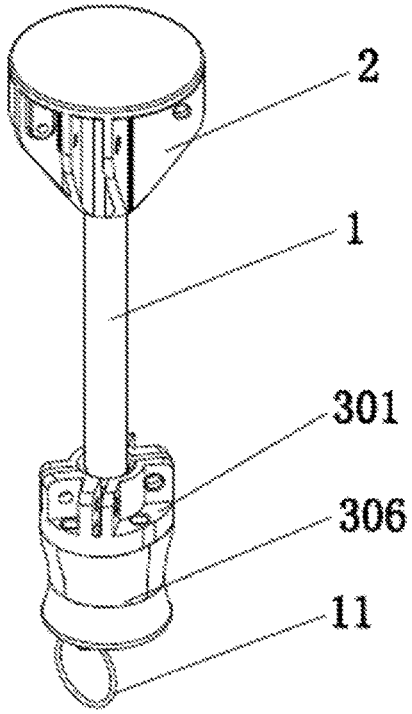
FIG. 12 is a schematic diagram of an entire structure of a central lock in an embodiment 3.
Figure 13:
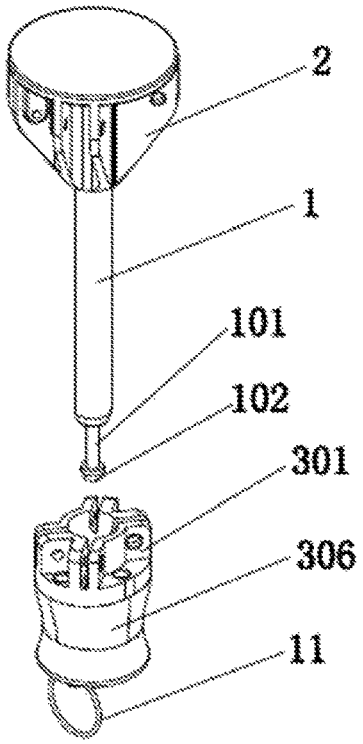
FIG. 13 is a schematic structural diagram when a lock plate in FIG. 12 is detached.
Figure 14:
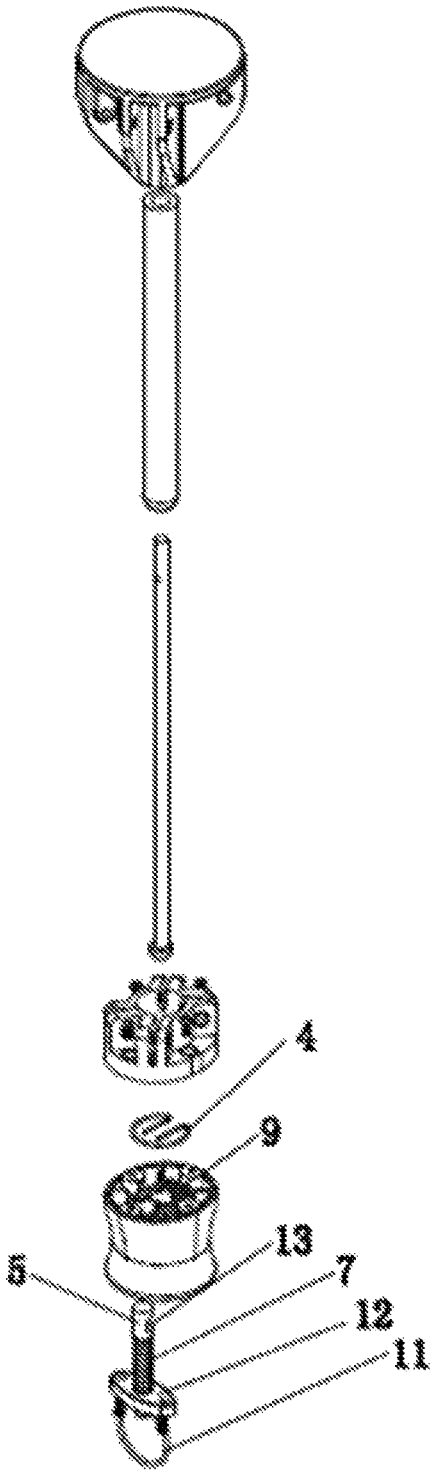
FIG. 14 is an expanded view of FIG. 12.
Figure 15:
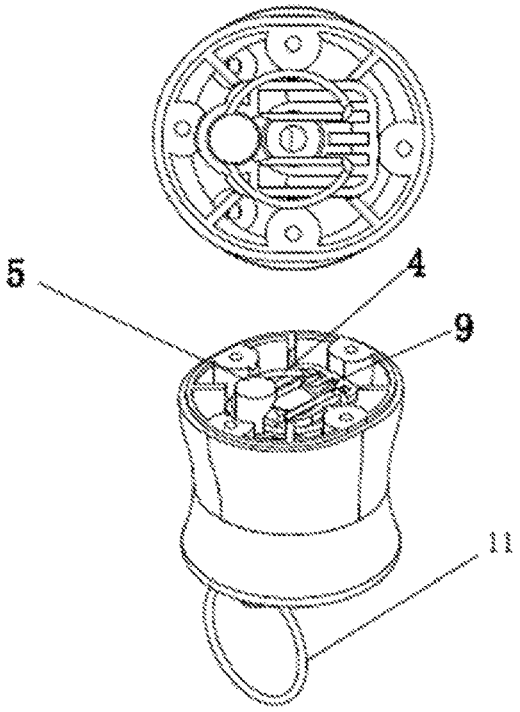
FIG. 15 is a schematic structural diagram of a lower lock plate assembly in the embodiment 3.
Figure 16:
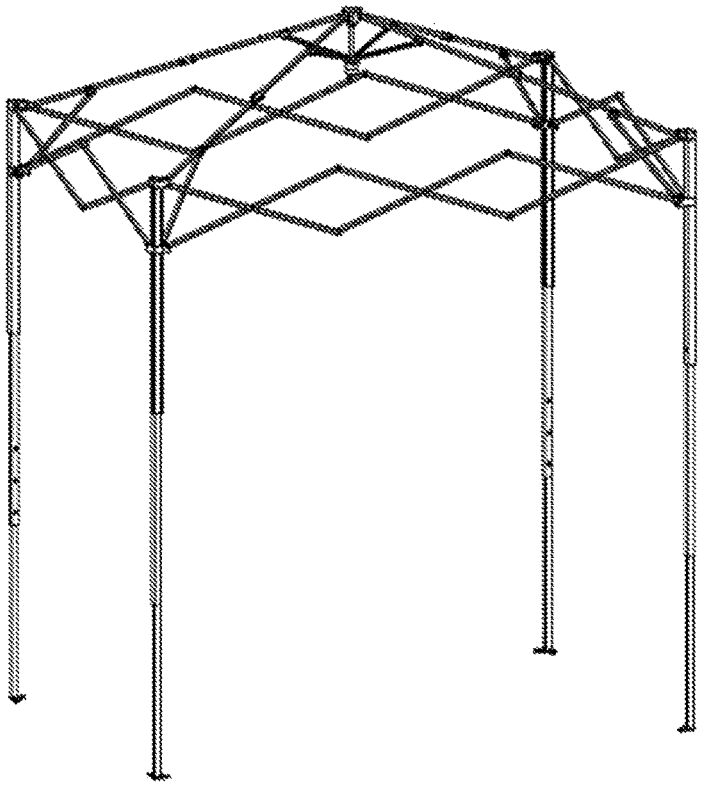
FIG. 16 is a schematic structural diagram when a central lock in the embodiment 3 is installed on a folding tent.
Figure 17:
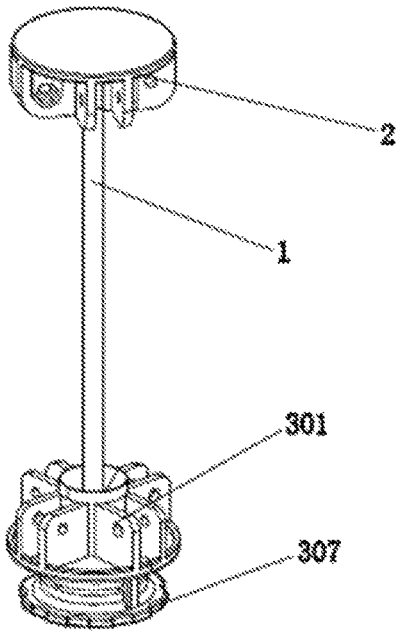
FIG. 17 is a schematic diagram of an entire structure of a central lock in an embodiment 4.
Figure 18:
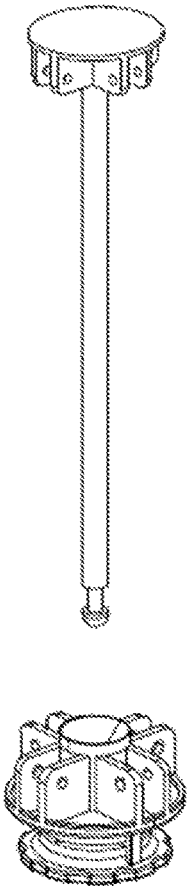
FIG. 18 is a schematic structural diagram when a lock plate in FIG. 17 is detached.
Figure 19:
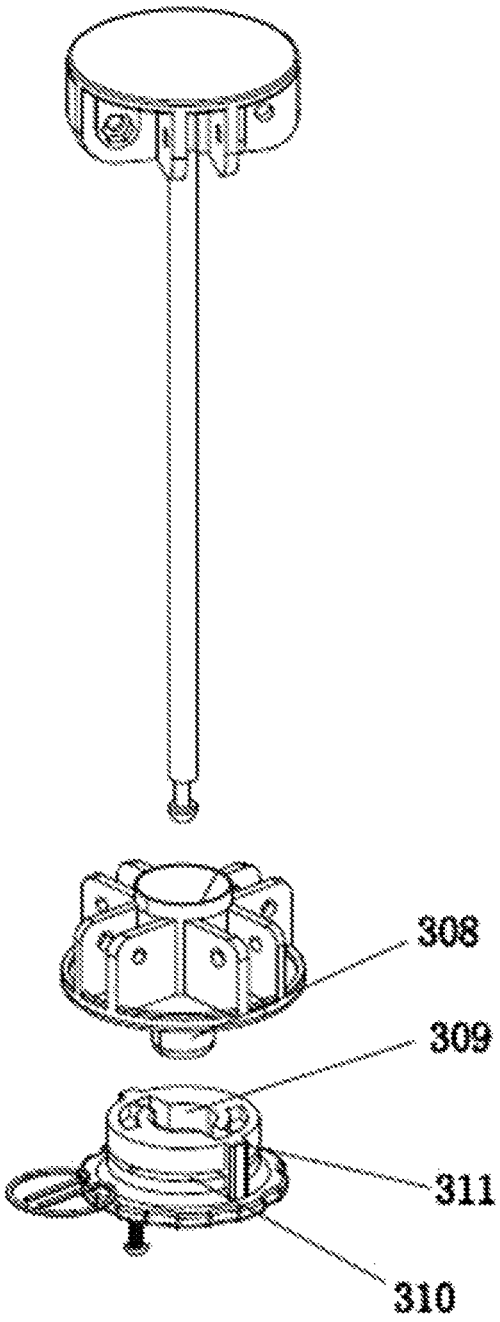
FIG. 19 is an expanded view of FIG. 17.
Figure 20:
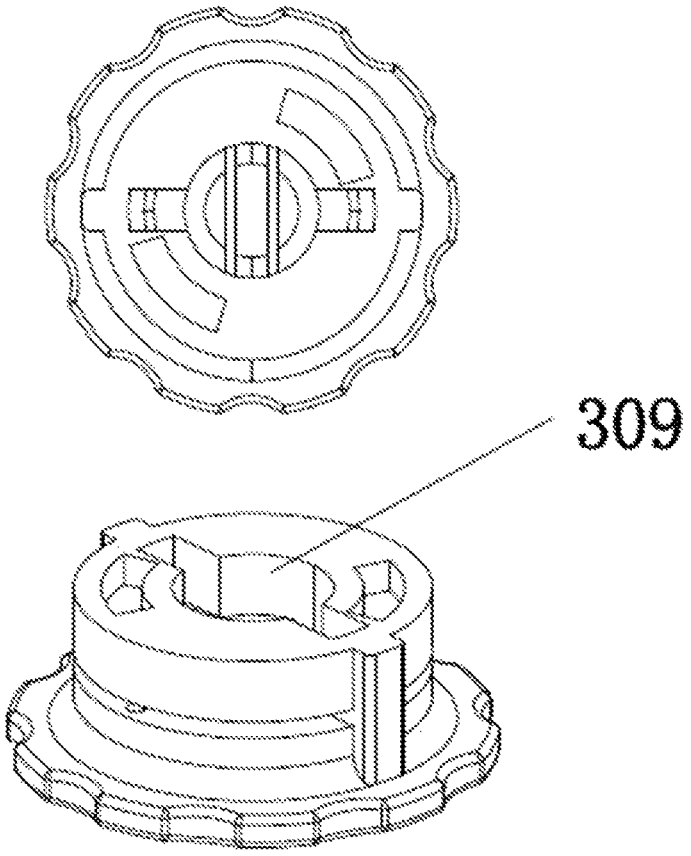
FIG. 20 is a schematic structural diagram of a lower lock plate assembly in the embodiment 3.
Figure 21:
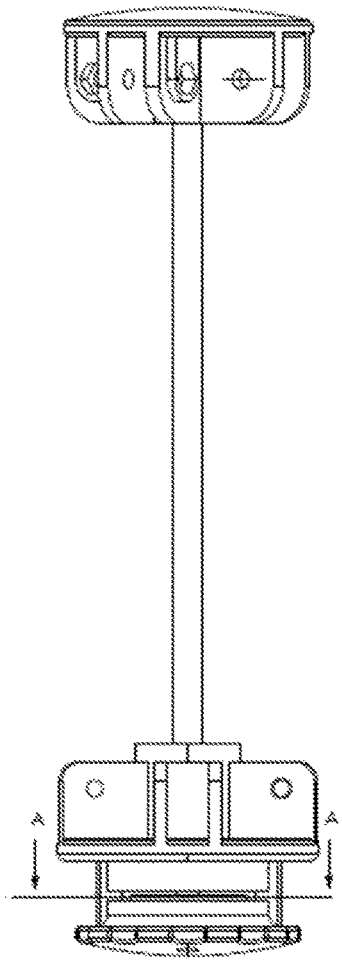
FIG. 21 is a section view of FIG. 17.
Figure 22:
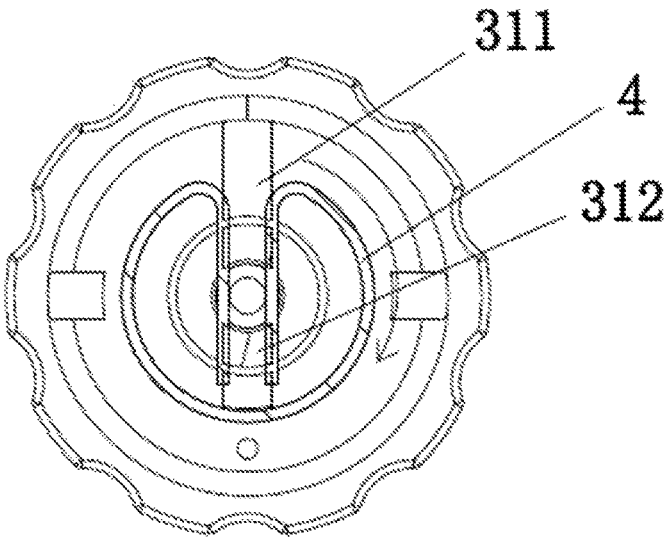
FIG. 22 is a section view of FIG. 21 taken along line A-A.
Figure 23:
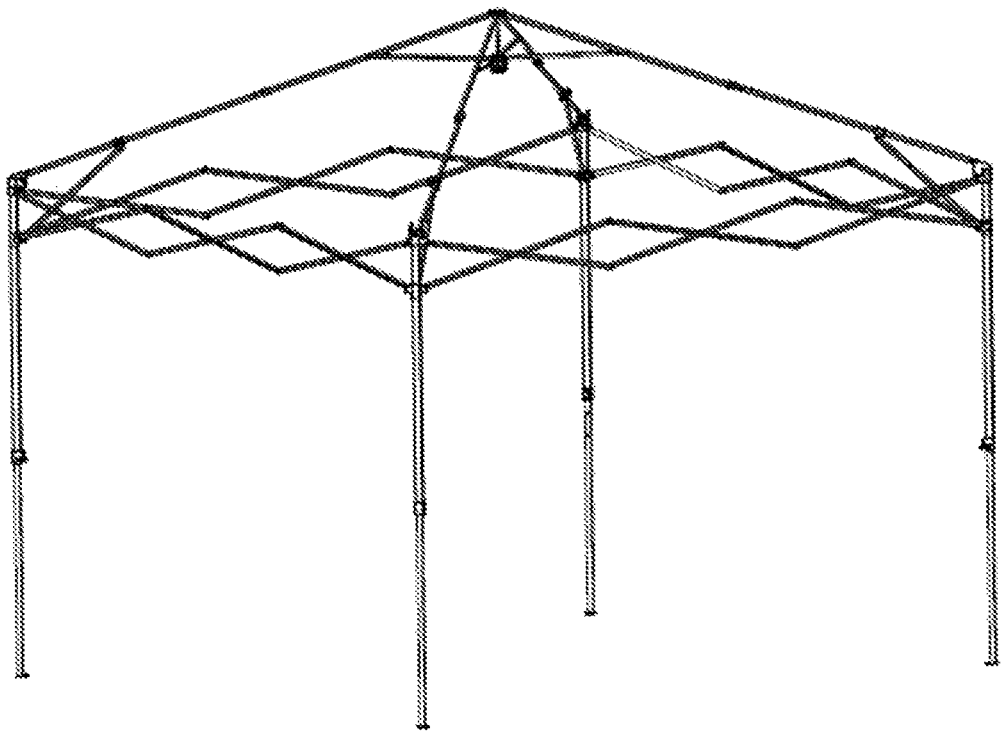
FIG. 23 is a schematic structural diagram when a central lock in the embodiment 3 is installed on a folding tent.

A central lock for a folding tent in the present invention includes a central lock rod 1, an upper lock plate 2 fixedly disposed at one end of the central lock rod 1, and a lower lock plate assembly 3 detachably connected to the other end of the central lock rod 1. An elastic locking member 4 and an unlocking mechanism used to control the elastic locking member 4 to be locked are disposed in the lower lock plate assembly 3. The upper lock plate 2 is hingedly connected to a long bone of the folding tent, and the lower lock plate assembly 3 is hingedly connected to a short bone of the folding tent. As shown in FIG. 1, the elastic locking member 4 in the present invention includes an arc-shaped portion 401 provided integrally and two horizontal locking rods 402 extending inwards from a gap of the arc-shaped portion 401, and a lower end portion of the central lock rod 1 is provided with a locking groove 101 used in cooperation with the locking rods 402 and a clamping and locking portion 102 located at a lower end of the locking groove 101.

Embodiment 1

As shown in FIG. 2 to FIG. 6, the lower lock plate assembly 3 in this embodiment includes an upper plate 301, an intermediate plate 302, and a lower plate 303. The upper plate 301 is hingedly connected to a short tent bone, and the upper plate 301 is fixedly connected to the intermediate plate 302 by a screw. A space used to place the elastic locking member 4 is disposed between the intermediate plate 302 and the upper plate 301, the lower plate 303 is sleeved on a lower end of the intermediate plate 302, guiding columns 304 are symmetrically disposed on an outer wall of the lower end of the intermediate plate 302, guiding troughs 305 are provided at locations, corresponding to the guiding columns 304, of an inner wall of the lower plate 303, and the guiding columns 304 and the guiding troughs 305 are cooperatively used, so that the intermediate plate 302 and the upper plate 301 slide up and down. The unlocking mechanism includes an unlocking block 5 and an unlocking column 6 fixedly disposed at a lower end of the unlocking block 5, the unlocking column 6 extends through the intermediate plate 302 to the lower plate 303 and is then fixed by a screw, the unlocking block 5 is in a trapezoid shape. An upper end of the unlocking block 5 has a width larger than that of the lower end of the unlocking block 5. In a locked state, a narrow portion of the lower end of the unlocking block 5 is clamped at the gap of the elastic locking member 4.

When unlocking is performed, the intermediate plate 302 is held in hand and pushed upwards, and moves upwards under an action of the guiding columns 304 and the guiding troughs 305, so that the elastic locking member 4 installed between the intermediate plate 302 and the upper plate 301 is driven to move upwards along the unlocking block 5. During the upward movement, a distance between the two locking rods 402 is gradually extended by the unlocking block 5, so that the locking rods 402 are detached from the locking groove 101, and the central lock rod 1 is detached from the elastic locking member 4, thereby implementing unlocking, that is, folding the tent.

Embodiment 2

As shown in FIG. 7 to FIG. 11, in this embodiment, the lower lock plate assembly 3 includes an upper plate 301 and a central base 306. The upper plate 301 and the central base 306 are fixedly connected by a screw. A space used to place the elastic locking member 4 is provided between the upper plate 301 and an upper portion of the central base 306. The unlocking mechanism extends through the central base 306 to lock the elastic locking member 4 and includes an unlocking block 5 an unlocking column fixedly disposed at a lower end of the unlocking block 5, a compression spring 7 sleeved on the unlocking column 6, a button cover 8 and an inclined conical surface block 9. The bottom cover is clamped on a bottom portion of the central base 306, and the unlocking column 6 is fixed on the button cover 8 after extending through the central base 306. A cross section of the unlocking block 5 is a triangle and a surface of an end of the unlocking block 5 is arc-shaped. An intermediate portion of the arc-shaped portion 401 of the elastic locking member 4 abuts on an upper end of an arc-shaped surface of the unlocking block 5. The inclined conical surface block 9 is correspondingly disposed at the gap of the elastic locking member 4. A width of an end, of the inclined conical surface block 9, close to the gap of the elastic locking member 4 is smaller, a width of an end far away from the gap of the elastic locking member 4 is larger, and the inclined conical surface block 9 is disposed on a bottom surface of the upper plate 301.

When the central lock disposed for the structure is unlocked, the button cover 8 needs to be first pressed to enable the button cover 8 to move upwards, so as to drive the unlocking columns and the unlocking block 5 to move upwards. During the upward movement, the unlocking block 5 gradually pushes the elastic locking member 4 to go away from the unlocking block 5 and moves horizontally. During the horizontal movement of the elastic locking member 4, the gap of the elastic locking member 4 is gradually extended by the inclined conical surface block 9, so that the locking rods 402 are detached from the locking groove 101, and the central lock rod 1 is detached from the elastic locking member 4, thereby implementing unlocking, that is, folding the tent. After unlocking is performed, the button cover 8 is loosened, and the unlocking block 5 is reset under an action of the compression spring 7.

Embodiment 3

As shown in FIG. 12 to FIG. 15, a structure in this embodiment is basically the same as the structure in the embodiment 2, and a difference lies in a specific structure of the unlocking mechanism. The unlocking mechanism includes a columnar unlocking block 5, an unlocking column 6 disposed at a lower portion of the columnar unlocking block 5, a compression spring 7, a pull ring 11, a pull ring fixing block 12, and an inclined conical surface block 9. The pull ring fixing block 12 is fixedly disposed at a bottom portion of the central base 306, the compression spring 7 is sleeved on the unlocking column 6, the pull ring 11 is disposed at an end portion of the unlocking column 6 after the unlocking column 6 extends through the pull ring fixing block 12, a side surface of the columnar unlocking block 5 is provided with an arc-shaped gap 13, an intermediate portion of the arc-shaped portion 401 of the elastic locking member 4 abuts on a lower end of the arc-shaped gap 13, and the inclined conical surface block 9 is correspondingly disposed at the gap of the elastic locking member 4. Specifically, the inclined conical surface block 9 is disposed in the central base 306.

When unlocking is performed, the pull ring 11 is pulled down, the unlocking block 5 moves downwards. When the unlocking block 5 moves downwards, the unlocking block 5 pushes the elastic locking member 4 to horizontally move. During the horizontal movement of the elastic locking member 4, the gap of the elastic locking member 4 is gradually extended by the inclined conical surface block 9, so that the locking rods 402 are detached from the locking groove 101, and the central lock rod 1 is detached from the elastic locking member 4, thereby implementing unlocking, that is, folding the tent. After unlocking is performed, the button cover 8 is loosened, and the unlocking block 5 is reset under an action of the compression spring 7.

Embodiment 4

As shown in FIG. 17 to FIG. 23, the lower lock plate assembly 3 in this embodiment includes an upper plate 301 and a rotary base 307. A central shaft 308 of a hollow structure is disposed on a lower bottom surface of the upper plate 301, and a center hole 309 through which the central shaft 308 extends is provided on the rotary base 307. Two outer annular installation grooves 310 that are spaced apart are formed on an outer wall of the rotary base 307, and two inner annular installation grooves are formed at locations, corresponding to the two outer annular installation grooves 310, on an outer wall of the central shaft 308. Outer limit blocks 311 are disposed between the two outer annular installation grooves 310, and inner limit blocks 312 are disposed between the two inner annular installation grooves. After the elastic locking member 4 enters from the outer annular installation grooves 310, outer sides of the gap of the elastic locking member 4 respectively abut on the two outer limit blocks 311, and the two locking rods 402 respectively abut on the two inner limit blocks 312. A width between the two locking rods 402 is not less than a width between the inner limit blocks 312.

When unlocking is performed, the rotary base 307 is screwed, an end of the gap of the elastic locking member 4 is located on a side of a movement direction of the outer limit blocks 311, and the outer limit blocks 311 squeeze and exert force on the end of the gap of the elastic locking member 4, to drive the locking rod 402 on the side to tilt. In addition, the locking rod 402 on the other side also tilts under an action of the outer limit block 311, so that a distance between the two locking rods 402 is increased and the two locking rods 402 are detached from the locking groove 101, and the central lock rod 1 is detached from the elastic locking member 4, thereby implementing unlocking.

What is claimed is:

1. A central lock for a folding tent, the central lock comprising a central lock rod, an upper lock plate fixedly disposed at one end of the central lock rod, and a lower lock plate assembly detachably connected to the other end of the central lock rod, wherein an elastic locking member and an unlocking mechanism used to control the elastic locking member to be locked are disposed in the lower lock plate assembly, the elastic locking member comprises an arc-shaped portion provided integrally and two horizontal locking rods extending inwards from a gap of the arc-shaped portion, and a lower end portion of the central lock rod is provided with a locking groove used in cooperation with the locking rods and a clamping and locking portion located at a lower end of the locking groove, wherein the lower lock plate assembly comprises an upper plate, an intermediate plate, and a lower plate, the upper plate is hingedly connected to a short tent bone, the upper plate is fixedly connected to the intermediate plate by a screw, a space used to place the elastic locking member is disposed between the intermediate plate and the upper plate, the lower plate is sleeved on a lower end of the intermediate plate, guiding columns are symmetrically disposed on an outer wall of the lower end of the intermediate plate, and a guiding trough is provided at locations, corresponding to the guiding columns, of an inner wall of the lower plate; the unlocking mechanism comprises an unlocking block and an unlocking column fixedly disposed at a lower end of the unlocking block, the unlocking column extends through the intermediate plate to the lower plate and is then fixed by a screw, the unlocking block is in trapezoid shape with a wider upper width and a narrower lower width, an upper end of the unlocking block has a width larger than that of the lower end of the unlocking block, and in a locked state, a narrow portion of the lower end of the unlocking block is clamped at the gap of the elastic locking member.

2. The central lock for the folding tent according to claim 1, wherein the lower lock plate assembly comprises the upper plate and a rotary base, a central shaft of a hollow structure is disposed on a lower bottom surface of the upper plate, a center hole through which the central shaft extends is provided on the rotary base, two outer annular installation grooves that are spaced apart are formed on an outer wall of the rotary base, two inner annular installation grooves are formed at locations, corresponding to the two outer annular installation grooves, of an outer wall of the central shaft, outer limit blocks are disposed between the two outer annular installation grooves, inner limit blocks are disposed between the two inner annular installation grooves, and after the elastic locking member enters from the outer annular installation grooves, outer sides of the gap of the elastic locking member respectively abut on the two outer limit blocks, and the two locking rods respectively abut on the two inner limit blocks.

3. The central lock for the folding tent according to claim 2, wherein a width between the two locking rods is not less than a width between the inner limit blocks.

4. A central lock for a folding tent, the central lock comprising a central lock rod, an upper lock plate fixedly disposed at one end of the central lock rod, and a lower lock plate assembly detachably connected to the other end of the central lock rod, wherein an elastic locking member and an unlocking mechanism used to control the elastic locking member to be locked are disposed in the lower lock plate assembly, the elastic locking member comprises an arc-shaped portion provided integrally and two horizontal locking rods extending inwards from a gap of the arc-shaped portion, and a lower end portion of the central lock rod is provided with a locking groove used in cooperation with the locking rods and a clamping and locking portion located at a lower end of the locking groove, wherein the lower lock plate assembly comprises an upper plate and a central base, the upper plate and the central base are fixedly connected by a screw, a space used to place the elastic locking member is provided between the upper plate and an upper portion of the central base, and the unlocking mechanism extends through the central base to lock the elastic locking member, wherein the unlocking mechanism comprises an unlocking block, an unlocking column disposed at a lower end of the unlocking block, a compression spring sleeved on the unlocking column, a button cover, and an inclined conical surface block, the bottom cover is clamped on a bottom portion of the central base, the unlocking column is fixed on the button cover after extending through the central base, a cross section of the unlocking block is a triangle and a surface of an end of the unlocking block is arc-shaped, an intermediate portion of the arc-shaped portion of the elastic locking member abuts on an upper end of an arc-shaped surface of the unlocking block, and the inclined conical surface block is correspondingly disposed at the gap of the elastic locking member.

5. The central lock for the folding tent according to claim 4, wherein a width of an end, of the inclined conical surface block, close to the gap of the elastic locking member is smaller, and a width of an end far away from the gap of the locking member is larger.

6. The central lock for the folding tent according to claim 4, wherein the inclined conical surface block is disposed on a bottom surface of the upper plate or a surface of an upper end of the central base.

7. A central lock for a folding tent, the central lock comprising a central lock rod, an upper lock plate fixedly disposed at one end of the central lock rod, and a lower lock plate assembly detachably connected to the other end of the central lock rod, wherein an elastic locking member and an unlocking mechanism used to control the elastic locking member to be locked are disposed in the lower lock plate assembly, the elastic locking member comprises an arc-shaped portion provided integrally and two horizontal locking rods extending inwards from a gap of the arc-shaped portion, and a lower end portion of the central lock rod is provided with a locking groove used in cooperation with the locking rods and a clamping and locking portion located at a lower end of the locking groove, wherein the lower lock plate assembly comprises an upper plate and a central base, the upper plate and the central base are fixedly connected by a screw, a space used to place the elastic locking member is provided between the upper plate and an upper portion of the central base, and the unlocking mechanism extends through the central base to lock the elastic locking member, wherein the unlocking mechanism comprises a columnar unlocking block, an unlocking column disposed at a lower portion of the columnar unlocking block, a compression spring, a pull ring, a pull ring fixing block, and an inclined conical surface block, the pull ring fixing block is fixedly disposed at a bottom portion of the central base, the compression spring is sleeved on the unlocking column, the pull ring is disposed at an end portion of the unlocking column after the unlocking column extends through the pull ring fixing block, a side surface of the columnar unlocking block is provided with an arc-shaped gap, an intermediate portion of the arc-shaped portion of the elastic locking member (4) abuts on a lower end of the arc-shaped gap, and the inclined conical surface block is correspondingly disposed at the gap of the elastic locking member.

8. The central lock for the folding tent according to claim 7, wherein a width of an end, of the inclined conical surface block, close to the gap of the elastic locking member is smaller, and a width of an end far away from the gap of the locking member is larger.

9. The central lock for the folding tent according to claim 7, wherein the inclined conical surface block is disposed on a bottom surface of the upper plate or a surface of an upper end of the central base.

* * * * *